United States Patent [19]

Cameron et al.

[11] Patent Number: 4,713,111

[45] Date of Patent: Dec. 15, 1987

[54] PRODUCTION OF ALUMINUM-Sic COMPOSITE USING SODIUM TETRASBORATE AS AN ADDITION AGENT

[75] Inventors: Thomas B. Cameron; Wilbur W. Swanson; John M. Tartaglia; Thomas B. Cox, all of Ann Arbor, Mich.

[73] Assignee: Amax Inc., Greenwich, Conn.

[21] Appl. No.: 894,548

[22] Filed: Aug. 8, 1986

[51] Int. Cl.[4] ..... C22C 1/09

[52] U.S. Cl. ..... 75/68 R; 420/528; 164/461; 148/437; 428/614

[58] Field of Search ..... 75/68 R, 93 AC, 257; 420/528; 164/461; 148/437; 428/614

[56] References Cited

U.S. PATENT DOCUMENTS 2,793,949 5/1957 Imich ..... 148/437

FOREIGN PATENT DOCUMENTS 456462 11/1936 United Kingdom ..... 75/68 R

*Primary Examiner*—Melvyn J. Andrews

*Attorney, Agent, or Firm*—Michael A. Ciomek; Eugene J. Kalil

[57] ABSTRACT

Reinforced composite aluminum-matrix articles containing silicon carbide fibers or particles, are produced by a casting process wherein the silicon carbide fibers or particles are mixed with dehydrated sodium tetraborate and mixed with molten aluminum or aluminum alloy whereby wetting of the reinforcing material and ready dispersal thereof in the aluminum matrix alloy is facilitated.

7 Claims, No Drawings

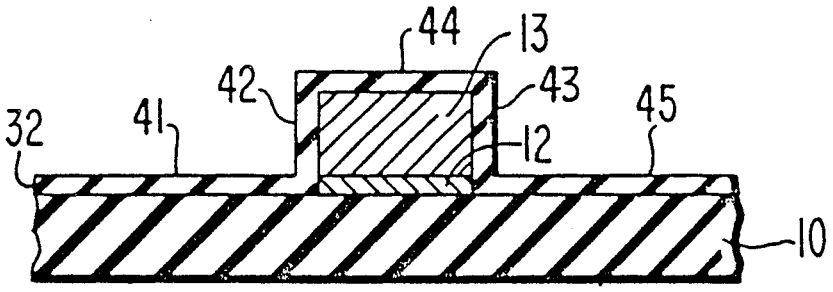

PRODUCTION OF ALUMINUM-SiC COMPOSITE USING SODIUM TETRASBORATE AS AN ADDITION AGENT

The invention is directed to a method for introducing particulate silicon carbide into a molten bath of aluminum or aluminum alloy.

BACKGROUND OF THE INVENTION

The art has recognized that the properties of aluminum can be improved in a number of significant ways by introducing dissimilar materials having little or no solubility in the aluminum matrix so as to produce a composite material having fibers or particles of reinforcing compounds such as zircon, alumina, zirconia, aluminum silicates, silicon carbide, graphite, etc. distributed substantially uniformly through the aluminum alloy matrix. The problem which has been encountered in successfully introducing such reinforcing materials into the molten metal matrix has been that of obtaining a wetting action between the melt and the surface of the solid reinforcing material so that the reinforcement will not be rejected by the melt and so that a strong bond between reinforcement and matrix will exist once the matrix metal has solidified. Thus, U.S. Pat. No. 3,885,959 discloses use of a nickel coating on particles such as graphite to cause wetting of the particle surface by molten aluminum. U.S. Pat. No. 3,905,557 proposed including magnesium in molten aluminum to obtain wetting of particles such as zircon and U.S. Pat. No. 4,012,204 proposed including lithium in molten aluminum to promote wetting of the melt in an infiltration process for producing a composite containing alumina fibers.

SUMMARY OF THE INVENTION

In accordance with the invention silicon carbide in particulate form is mixed with an approximately equal weight proportion of dehydrated sodium tetraborate or borax and the mixture is stirred into a molten bath of aluminum or aluminum alloy whereupon the silicon carbide particles are caused to become wetted and distributed through the aluminum melt.

DETAILED DESCRIPTION OF THE INVENTION

The typical practice for preparing the composite using sodium tetraborate is as follows. Sodium tetraborate decahydrate ($Na_2B_4)_7$. $10H_2O$), commonly called borax or sodium borate, is preheated at 250° C. to drive off the water vapor. The sodium tetraborate is mixed with SiC particles. Aluminum or one of its alloys is melted in a graphite crucible, the borax-SiC mixture is placed on top of the melt, the mixture is stirred and the crucible is removed from the furnace and cooled. Commercial purity aluminum or one of its alloys can be used, and pretreatment of the SiC is not necessary to obtain good wetting or mixing. After solidification, the composite ingot may be further processed by extrusion or other forming processes.

In accordance with the invention, the aluminum alloy bath to form the matrix of the final composite material may contain up to about 7% copper, up to about 20% silicon, up to about 11% magnesium, up to about 9% zinc, up to about 23% tin, up to about 3% iron, and the balance essentially aluminum.

Particulate silicon carbide materials used in accordance with the invention will generally have an average particle size less than about 50 microns; e.g. about 5 to about 70 microns. Fibers introduced as dispersions may have an average diameter of about 0.1 to about 15 microns and an average length of about 10 microns to about 5 centimeters.

Examples will now be given.

EXAMPLE 1

138 gm of dehydrated sodium tetraborate were mixed with 138 gm of 280 mesh (42 micron) silicon carbide. 524 gm of commercial aluminum alloy 6061 were melted in air in a graphite crucible that had been preheated at 690° C. The 50 wt. % silicon carbide-50 wt. % sodium tetraborate mixture was added when the molten aluminum was at a temperature of 800° C. The 6061-17 wt. % silicon carbide-17 wt. % sodium tetraborate mixture was mechanically stirred and the crucible was cooled. The SiC was satisfactorily wet (mixed) in the solidified aluminum alloy.

EXAMPLE 2

136 gm of dehydrated sodium tetraborate were mixed with 72 gm of 280 mesh (42 micron) silicon carbide. 592 gm of commercial aluminum alloy 6061 were melted in air in a graphite crucible that had been preheated at 690° C. The 65 wt. % silicon carbide-35 wt. % sodium tetraborate mixture was added when the molten aluminum was at a temperature of 800° C. The 6061-17 wt. % silicon carbide-9 wt. % sodium tetraborate mixture was mechanically stirred and the crucible was cooled. The SiC was satisfactorily wet in the aluminum alloy.

The silicon carbide particles and the dehydrated sodium tetraborate can be mixed in a weight ratio of silicon carbide to borax of about 1:1 to 2:1. The mixture is introduced into a molten bath of aluminum or aluminum alloy while the bath temperature is above the liquidus temperature thereof. An amount of about 5% to about 40%, by volume, of silicon carbide can be introduced into the bath by mixing.

Composites produced in accordance with the invention have improved strength, hardness, stiffness, wear resistance and/or other improved properties as compared to the properties of the aluminum alloy matrix without the dispersed dissimilar phase.

It will of course be appreciated that nonmetallic reinforcing materials distributed throughout an aluminum metal matrix by mixing will be randomly dispersed but will nevertheless strengthen the matrix as long as the reinforcement is wetted by the molten matrix metal and is firmly bonded thereto in the solid state.

Although the present invention has been described in conjunction with preferred embodiments, it is to be undersood that modifications and variations may be resorted to without departing from the spirit and scope of the invention, as those skilled in the art will readily understand. Such modifications and variations are considered to be within the purview and scope of the invention and appended claims.

We claim:

1. The process for introducing particulate silicon carbide into molten aluminum or aluminum alloy which comprises mixing particulate silicon carbide from the group consisting of particles having an average size of about 5 to about 70 microns and fibers having an average diameter of about 0.1 to about 15 microns and a length of about 10 microns to about 5 centimeters with a dehydrated addition agent of sodium tetraborate in weight proportions of 1:1 to 2:1, introducing the resulting mixture into an aluminum or aluminum alloy bath at a temperature above the liquidus temperature of the bath in an amount of about 5% to about 40% of silicon carbide, by volume of said bath to disseminate said silicon carbide particles throught said bath and solidifying said bath to produce a composite material reinforced with silicon carbide particles or whiskers distributed in a matrix of aluminum or aluminum alloy.

2. The process in accordance with claim 1 wherein said silicon carbide and said addition agent are mixed in approximately equal weight proportions.

3. The method in accordance with claim 1, wherein said aluminum-base alloy consists essentially of, by weight, up to about 7% copper, up to about 20% silicon, up to about 11% magnesium, up to about 9% zinc, up to about 23% tin, up to about 3% iron and the balance essentially aluminum.

4. The method in accordance with claim 1 wherein said mixing is accomplished by stirring.

5. The method in accordance with claim 1 wherein said mixed bath is cast into a static mold.

6. The method in accordance with claim 1 wherein said mixed bath is solidified by continuous casting.

7. The method in accordance with claim 1 wherein said mixed bath is solidified by direct chill (semi-continuous) casting.

* * * * *